US005219635A

United States Patent [19]

Weiter et al.

[11] Patent Number: 5,219,635

[45] Date of Patent: Jun. 15, 1993

[54] SHEATHING WEB

[75] Inventors: Bertrand C. Weiter, Augsburg; Franz Kaulich, Bobingen, both of Fed. Rep. of Germany

[73] Assignee: Hoechst Aktiengesellschaft, Fed. Rep. of Germany

[21] Appl. No.: 687,318

[22] Filed: Apr. 18, 1991

[30] Foreign Application Priority Data

Apr. 21, 1990 [DE] Fed. Rep. of Germany ..... 4012718

[51] Int. Cl.[5] ..... B32B 3/00; E04B 7/02; B31F 1/22

[52] U.S. Cl. ..... 428/172; 428/74; 428/147; 428/150; 428/219; 428/245; 428/260; 428/291; 428/340; 52/94; 156/47; 156/209; 156/219; 264/167; 264/175; 427/138; 427/186; 427/198; 427/275

[58] Field of Search ..... 428/147, 150, 156, 172, 428/74, 76, 96, 219, 245, 260, 287, 289, 291, 295, 340, 365, 480; 52/41, 57, 80, 90, 94, 518, 792, 814; 156/47, 209, 219; 264/175, 167, 294, 299; 427/138, 186, 198, 275, 276, 288

[56] References Cited

U.S. PATENT DOCUMENTS 4,446,187 5/1984 Eklund ..... 428/136

*Primary Examiner*—Donald J. Loney
*Attorney, Agent, or Firm*—Connolly & Hutz

[57] ABSTRACT

There is described a sheathing web consisting essentially of a waterproof-coated spunbonded of filaments of organic fiber-forming material. The sheathing web has on at least one surface a structure in the form of a weave pattern for increasing the slip resistance, this pattern having been embossed into the spunbonded in the course of its production.

13 Claims, No Drawings

SHEATHING WEB

DESCRIPTION

The invention relates to a sheathing web of improved slip resistance based on a waterproofed spunbonded, to a process for manufacturing same, and to the use of the waterproofed spunbonded as a sheathing web.

Steeply pitched roofs are customarily constructed with wood sheathing. This sheathing requires on the upside a sheathing web. Sheathing webs should on the one hand be water-impermeable and on the other air- and vapor-permeable. They should also be very strong, in particular in terms of tear propagation resistance and nail pullout resistance. Furthermore, they should possess slip resistance on one side to give the roofer a firm foothold.

Commercial sheathing webs consist essentially of a bitumen-coated glass web (cf. for example Ullmanns Encylopädie der technischen Chemie, 4th edition, volume 11, page 371, Verlag Chemie, Weinheim/Bergstr., 1976). The antislip side of such webs is customarily made by lamination with a fine web and by treatment with structured rolls in the course of bitumenization. The bitumen content of typical commercial sheathing webs is about 500 g/m$^2$.

It is an object of the present invention to provide a sheathing web which does not need a fine web and which offers high slip resistance and thus a high degree of safety. A further object is to provide a sheathing web which is simple to produce, since the prior art bitumen embossing operation by the roofing membrane manufacturer is omitted; which is simple to lay, so as to make it possible to use low final sheet weights; and which has a high tear propagation resistance and nail pullout resistance. For instance, it should be possible to obtain nail pullout resistances of 60-220 N (measured by the UEATC test method).

Accordingly, the present invention provides a sheathing web which consists essentially of a spunbonded web of filaments of organic fiber-forming material with an embossed weave pattern which has been rendered waterproof with a coating agent, said sheathing web having at least on one surface, preferably just the one surface, a structure in the form of a weave pattern for increasing the slip resistance.

A structure in the form of a weave pattern is for the purposes of the present invention a structure as also encountered in woven fabrics. This structure is produced by embossing in the course of the manufacture of the spunbonded and is retained on the sheathing web even after application of the coating agent. It is possible to use customary weave patterns, such as patterns in the form of satin/sateen weaves, in the form of twill weaves and in particular in the form of plain weaves. The depth of this pattern in the sheathing web, i.e. the difference between the highest elevations and the deepest adjacent depressions, is selected in such a way as to impart an adequate degree of slip resistance. Typical values of the depth of a weave pattern are within the range from 0.05 to 0.3 mm. More particularly, the sheathing web has a weave pattern in the form of a plain weave about 0.2 mm in depth.

The coating agents used are all conventional organic compounds with which the spunbonded can be given a waterproof finish. The coating agent may be a synthetic resin, such as polyethylene or polyvinyl chloride. However, it is also possible to use natural coating agents. Very particular preference is given to bitumen.

The spunbonded may be made of any desired filaments of an organic fiber-forming material. Examples thereof are polyethylene, polypropylene, polyamide and in particular polyester. It is also possible to use mixtures of these types of filament.

The filaments are formed into a web in a conventional manner and then mechanically or in particular thermomechanically preconsolidated, for example by calendering by means of smooth calenders or preferably by means of embossing calenders. Even at this stage it is thus possible to emboss the spunbonded with the weave pattern. However, this pattern can also be produced by a separate embossing step after the spunbonded has been consolidated. Following the preconsolidation of the spunbonded, the final consolidation may be effected for example with a binder. Suitable binders are all agents customary for this purpose, for example polyacrylate dispersions, polyvinyl ester dispersions, polyvinyl alcohol, polyurethane dispersions, or amino or phenolic resin precondensates. The proportion of such binders is customarily 5-25% by weight. Of particular suitability are binder fibers, which may be added even at the web formation stage.

Particular preference is given to using spunbondeds based on polyester fibers, in particular those which have been consolidated with a fusible binder.

Typical values of the sheet weights of the spunbondeds to be used vary within the range between 60 and 120 g/m$^2$, preferably from 80 to 100 g/m$^2$.

The thickness of the spunbondeds to be used is customarily between 0.20 and 0.50 mm, in particular between 0.30 and 0.40 mm.

In a particularly preferred embodiment, the spunbonded is composed of load-carrying filaments made of polyester and of fusible binder filaments, also made of polyester, its sheet weight is between 60 and 100 g/m$^2$, the deniers of the load-carrying filaments and the binder filaments are within the range between 1 and 7 dtex, and the proportion of binder filaments is up to 12% by weight.

Preferably, the sheet weight of such spunbondeds is between 60 and 90 g/m$^2$, the filament denier is between 1 and 5 dtex, in particular 1 and 4 dtex, and the proportion of binder filaments is between 5 and 10 percent by weight. The denier of the binder filaments is preferably less than the denier of the load-carrying filaments.

The load-carrying filaments are preferably made of polyethylene terephthalate, while the fusible binder is made of polymers whose melting point is below the melting point of the load-carrying filaments. Preference is given to fusible binder filaments made of a polyester which has been modified with isophthalic acid and accordingly has a reduced melting point.

More particularly, the load-carrying filaments at least may be made of polyesters which have been modified to be flame-retardant, as described for example in German Patent 2,346,787.

Preferably, the binder filaments are likewise made of a flame-retardant raw material, in particular isophthalic acid-modified polyesters, or else for example of polybutylene terephthalate as also described in German Patent 2,526,749.

Very particularly preferred spunbondeds of this type are defined by binder filaments whose melting point is less than 30° C., preferably less than 20° C., below the melting point of the load-carrying filaments. Sheathing webs made of these spunbondeds can be (further) processed at high temperatures and have a particularly high thermal resistance.

Particular preference is given to using lofty spunbondeds of this type which are obtained with a minimum amount of binder filaments and a sieve drum fixation operation. These spunbondeds then also have a surface structure with many fiber ends, which distinctly increases the adhesion of the coating agent.

In a further particularly preferred embodiment, the spunbonded is composed of load-carrying filaments made of polyester and of fusible binder filaments, also made of polyester, especially a modified polyethylene terephthalate which has flame-retardant properties.

In this spunbonded, the load-carrying filaments are generally made of unmodified polyesters, preferably polyethylene terephthalate, and the binder filaments of low-flammability polyesters which preferably contain dicarboxylic acid and diol components and cocondensed P-containing chain members. Preferably, the sheet weight of these spunbondeds is above 60 g/m$^2$, and particularly preferably the denier of the load-carrying filaments and the binder filaments is within the range between 1 and 7 dtex.

Preferably, the sheet weight of these spunbondeds is between 60 and 120 g/m$^2$, the filament denier is between 1 and 10 dtex, in particular 1 and 5 dtex, and the proportion of binder filaments is between 5 and 20 percent by weight. The denier of the binder filaments is preferably less than the denier of the load-carrying filaments.

Preferably, the fusible binder is made of a modified polyethylene terephthalate as described for example in German Patent 2,346,787, which accordingly has a reduced melting point. The melting point of the binder filaments with these preferred spunbondeds is 20° C., in particular 15° C., below the melting point of the matrix filaments. The polyesters of the binder filaments in these preferred spunbondeds are generally made of dicarboxylic acid and diol components and of phosphorus-containing chain members and are defined in that the phosphorus-containing chain members are structural units of the formula

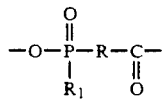

which account for about 3–20 mol percent of the acid component of the polyester, with R being a saturated, open-chain or cyclic alkylene radical of preferably 1–15 carbon atoms or an arylene or aralkylene radical and $R_1$ being an alkyl radical of preferably up to 6 carbon atoms, or an aryl or aralkyl radical.

The dicarboxylic acid starting materials for polyesters of the spunbondeds to be used according to the present invention include not only the preferred terephthalic acid but also other dicarboxylic acids, preferably as cocomponents. Possibilities here are for example isophthalic acid, 5-sulfoisophthalic acid, 5-sulfopropoxyisophthalic acid, naphthalene-2,6-dicarboxylic acid, biphenyl-p,p'-dicarboxylic acid, p-phenylenediacetic acid, p,p'-oxydibenzoic acid, diphenoxyalkanedicarboxylic acids, trans-hexahydroterephthalic acid, adipic acid, sebacic acid, or 1,2-cyclobutanedicarboxylic acid. Suitable diol components, in addition to the preferred ethylene glycol, are for example 1,3-propanediol, 1,4-butanediol and the higher homologs of 1,4-butanediol, also 2,2-dimethyl-1,3-propanediol, 1,4-cyclohexanedimethanol, etc., also for use as cocomponents.

If in addition to terephthalic acid others of the dicarboxylic acids mentioned are used, preferably not significantly more than 10 mol percent of the total acid component is employed. A similar restriction applies to the composition of the diol component. If for example further diols are used here as cocomponents with ethylene glycol, their amount is preferably likewise not significantly more than 10 mol percent of the total diol component.

In a further embodiment of the invention, the spunbonded contains an antistat, for example carbon black, introduced into the spunbonded by means of the binder filaments.

To manufacture the sheathing web of the present invention, the spunbonded is finished on one or both sides with a coating agent, preferably with bitumen. This may be effected by brushing the spunbonded with the coating agent or by saturating the spunbonded with the coating agent, if necessary followed by the removal of excess coating agent by wiping off or squeezing off.

The proportion of coating agent in the ready-produced sheathing web is customarily about 140–280 g/$^2$.

The sheet weight of the ready-produced sheathing web is in general about 200–400 g/m$^2$, preferably 300–400 g/m$^2$.

The amount of coating agent and its consistency in the finishing of the spunbonded are chosen in such a way that the weave pattern embossed into the spunbonded is retained in the ready-produced sheathing web. It is true that the pattern is levelled out by the treatment with the coating agent, making the differences between the highest and the lowest points of the pattern smaller, but it is possible to choose the conditions for the coating in such a way that the weave pattern for increasing the antislip resistance will be preserved in the ready produced sheathing web. The invention also provides a process for manufacturing the sheathing web, as defined in claim 10.

After manufacture, the sheathing web may be lightly sprinkled on one or both sides with an antistick agent such as talc or sand, to prevent any adhering in the roll form.

This manufacturing technique saves the roofing membrane producer additional operations, such as the application of a fine web or the use of rolls with specific surface properties for producing a surface structure in the sheathing web. The elimination of these operations results in a cost saving. Moreover, less coating agent is required than previously customary. The invention also concerns the use of the waterproof-coated webs of the above-defined type as sheathing web.

We claim:

1. A sheathing web comprising a web rendered waterproof with a coating agent, said web including a consolidated spunbonded of filaments of an organic fiber-forming material, and an embossed weave pattern, at least one surface of the web for increasing the slip resistance of the web.

2. The sheathing web of claim 1, wherein the surface structure has the shape of a plain weave.

3. The sheathing web of claim 2, wherein the depth of said plain weave is about 0.05–0.3 mm.

4. The sheathing web of claim 1, wherein the coating agent is bitumen.

5. The sheathing web of claim 1, wherein the organic fiber-forming material is polyester.

6. The sheathing web of claim 1, wherein the spunbonded has been consolidated with a fusible binder.

7. The sheathing web of claim 6, wherein the fusible binder-consolidated spunbonded is a web composed of load-carrying filaments and fusible binder filaments, made of polyester, the spunbonded having a sheet weight of from 60 to 100 g/m$^2$, the denier of the load-carrying filaments and of the binder filaments being from 1 to 7 dtex and the proportion of binder filaments, based on the spunbonded, being up to 12% by weight.

8. The sheathing web of claim 7, wherein the melting point of the binder filaments is less than 30° C. below the melting point of the load-carrying filaments.

9. The sheathing web of claim 6, wherein the fusible binder-consolidated spunbonded is a web composed of load-carrying filaments and of fusible binder filaments, made of polyester, the binder filaments being made of a modified polyethylene terephthalate which has flame-retardant properties.

10. The sheathing web of claim 1, wherein the sheet weight of the sheathing web is from 300 to 400 g/m$^2$.

11. A process for manufacturing the sheathing web of claim 1, comprising the steps:

i) forming a consolidated spunbonded from filaments of organic fiber-forming material in a conventional manner, ii) applying an embossed structure in the form of a weave pattern on at least one of the surfaces of the spunbonded by embossing with a calender, and iii) coating the embossed web with a coating agent in a conventional manner and in such an amount as to retain on at least one surface a structure in the form of a weave pattern for increasing the slip resistance and as to render the sheathing web watertight, with the proviso that step ii) may also be carried out together with the consolidation of the spunbonded.

12. The process of claim 11, wherein the coating agent is bitumen.

13. A process of manufacturing a steeply pitched roof, which process comprises the use of the coated web of claim 1 as a sheathing web.

* * * * *

UNITED STATES PATENT AND TRADEMARK OFFICE

CERTIFICATE OF CORRECTION

PATENT NO. : 5,219,635

DATED : June 15, 1993

INVENTOR(S) : Bertrand C. Weiter, et al

It is certified that error appears in the above-indentified patent and that said Letters Patent is hereby corrected as shown below:

Column 4, line 27, "$g/_2$" should read -- $g/m_2$ --.

Column 4, line 62 (claim 1, line 5), delete the comma "," (second occurrence)

and insert -- on --.

Signed and Sealed this

Eighth Day of February, 1994

Bruce Lehman

*Attest:*

BRUCE LEHMAN

*Attesting Officer*

*Commissioner of Patents and Trademarks*